United States Patent [19]

Hawkins et al.

[11] Patent Number: 4,705,264

[45] **Date of Patent: * Nov. 10, 1987**

[54] WHEELED STAND ASSEMBLY

[76] Inventors: Joel W. Hawkins, P.O. Box 627, Travelers Rest, S.C. 29690; Patrick G. Hawkins, P.O. Box 3867, Greenville, S.C. 29608

[ * ] Notice: The portion of the term of this patent subsequent to Jun. 2, 2004 has been disclaimed.

[21] Appl. No.: 761,176

[22] Filed: Jul. 31, 1985

Related U.S. Application Data

[63] Continuation-in-part of Ser. No. 539,755, Oct. 6, 1983, Pat. No. 4,533,127.

[51] Int. Cl.[4] ..... B66F 3/00

[52] U.S. Cl. ..... 269/17; 269/47

[58] Field of Search ..... 254/8 R, 8 B, 124, 7 B, 254/7 R, 4 B, 4 R; 269/16, 17, 52, 47; 188/1.12, 29, 74, 83; 16/35 R, 42 R, 42 T, 43, 39

[56] References Cited

U.S. PATENT DOCUMENTS

| | | | |
|---|---|---|---|
| 1,614,697 | 1/1927 | Snook | 269/17 |
| 2,895,729 | 7/1959 | Sanders | 269/17 |
| 3,521,860 | 7/1970 | Zehrung et al. | 254/8 R |
| 3,584,836 | 6/1971 | Brubaker | 254/124 |
| 4,021,017 | 5/1977 | Adams | 254/8 B |
| 4,183,511 | 1/1980 | Marek | 269/17 |
| 4,479,632 | 10/1984 | McIntire et al. | 254/8 B |

*Primary Examiner*—Robert C. Watson
*Attorney, Agent, or Firm*—Bailey & Hardaway

[57] ABSTRACT

A wheeled stand is illustrated for use as an engine mount having a special post mount and utilizing a tray forming a frame to facilitate assembly of the base.

5 Claims, 4 Drawing Figures

WHEELED STAND ASSEMBLY

This application is a continuation-in-part of Hawkins, Ser. No. 06/539,755 filed Oct. 6, 1983, now U.S. Pat. No. 4,533,127.

BACKGROUND OF THE INVENTION

The prior art is illustrated in the drawings as including an engine stand supported by casters which includes a single forwardly extending tubular section affording together with the transverse base section, a three point support. The post is vertical and must be welded to the base or welded to something which has a fixed connection with or is a part of the base. Relatively expensive locking mechanism must be provided for the wheeled supports since locking must be provided when exerting a torque upon engine parts during use of the stand. Since such a torque is transferred to the stand, such would otherwise cause stand to move about. Since the posts are welded and have a substantial bending moment placed therein by the engine being in canter-levered relationship therewith, the parts must be constructed from relatively heavy expensive material. The resulting stands must be shipped in assembled relation. U.S. Pat. Nos. 3,381,953 and 3,931,956 are illustrative of the prior art.

Accordingly, it is an important object of this invention to provide an improved post arrangement wherein the post is inclined rearwardly from a pivot point between a pair of diverging base forming members and supported by upright straps so as to provide stability avoiding rocking in all directions.

Another important object of the invention is the provision of a thumb screw brake for use on the wheels of the stand to avoid movement of the stand when torquing the engine which includes an upright threaded member which may be manually moved into and out of braking engagement with a peripheral portion of the wheel.

Still another important object of the invention is to provide an engine stand which may be disassembled with the parts being folded together to facilitate shipping. The particular structure also makes possible the use of lighter, less expensive construction material while providing increased stability.

Yet another object of the invention is the provision of a transverse base member or frame capable of functioning as a tray as well as facilitating the assembly of a wheeled stand carrying a desired implement or tool.

SUMMARY OF THE INVENTION

It has been found that a more stable wheeled stand may be provided utilizing a post carried between a pair of diverging base members which is tilted rearwardly and supported by a pair of upwardly converging straps for engagement with the post. The parts may be disassembled for shipping and greater stability is provided. A thumb screw braking arrangement is provided utilizing a threaded shank which is adjustable into and out of braking arrangement with the wheels. By utilizing a pair of longitudinally spaced transverse structural sections and a pair of end frame members bridging the structural sections a support frame may be formed which acts as a tray as well as means for removably supporting the post. In the modified form of the invention the longitudinal base portion is formed of structural members spaced at each end of the transverse base member which is formed of structural members as a tray.

It has been found that by utilizing the above construction, greater stability may be afforded together with the provision of a four wheel rather than a three wheel support.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an engine stand having a wheeled base formed from a tubular transverse base member and a longitudinal base portion which extends forwardly from the transverse base member. A post is carried by the longitudinal base portion inclined rearwardly toward the transverse base portion. A pair of upright straps B are carried by the transverse base member on one end, tapering inwardly toward and being connected to the post on the other end. Engine mounting means C are carried adjacent an upper end of the post extending outwardly above and in alignment with the longitudinal base portion. The longitudinal base portion includes a pair of structural members each having a first section D extending outwardly from the transverse base member in general longitudinal alignment, and a second section E diverging outwardly from each of the first sections. Fastening means securing the post between said first sections remote from the transverse base member. An upper bridging member F and depending supports carried thereby, carry a wheel mounted for rotation between the depending supports. An adjustable threaded member G is carried by the bridging member extending into and out of braking engagement with a peripheral portion of the wheel.

Figure 1:
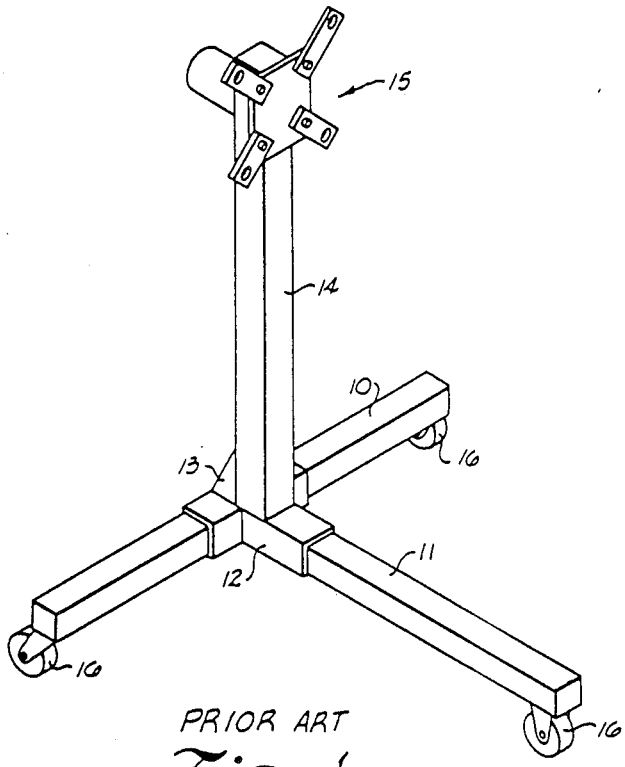
PRIOR ART Fig. 1
FIG. 1 is a perspective view illustrating an engine stand constructed in accordance with the prior art.

Referring more particularly to the drawings, FIG. 1 illustrates the prior art as including a transverse base member 10 constructed of a tubular section. A longitudinally extending tubular section 11 is secured to a junction member 12. The transverse base member 10 may be constructed in two parts which are connected to the junction member 12. A gusset plate 13 is provided to support the post member 14 which is welded thereto and to the junction member 12. Engine mounting means are broadly designated at 15 and are positioned atop the post 14. The stand is illustrated as being supported by casters 16 although the braking mechanism which generally includes a foot operated lever has been omitted.

Figure 2:
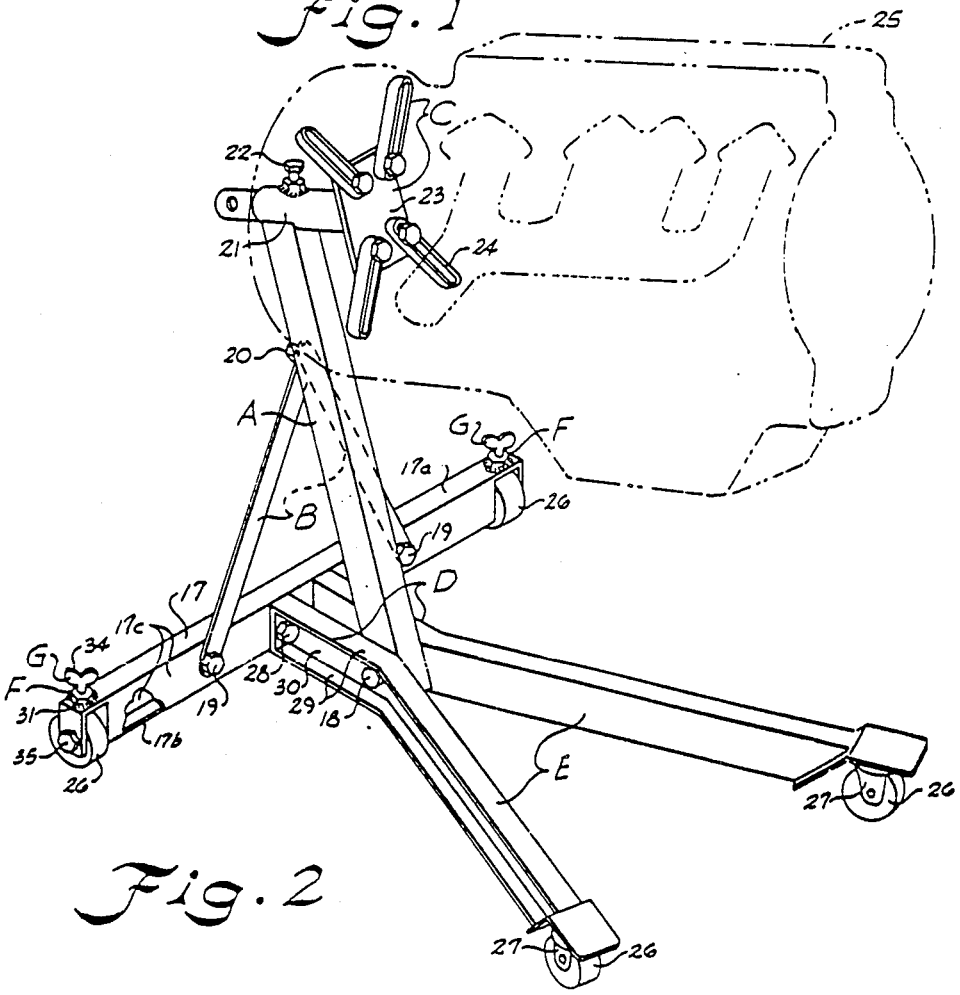
FIG. 2 is a perspective view illustrating an engine stand constructed in accordance with the present invention wherein the main support post is inclined rearwardly and supported by upright straps and wherein upright thumb screws are provided for engaging the periphery of the wheels at right angles thereto.

FIG. 2 illustrates the engine stand constructed in accordance with the invention wherein a wheeled base is formed from a tubular transverse member 17 which includes an upper bridging or web portion 17*a* opposite a lower web portion 17*b*. A pair of sides or flanges are illustrated at 17*c*.

A longitudinal base portion extends forwardly from the transverse tubular base member 17 and serves as a mounting for a lower portion of the post A which includes a base portion which is pivotally carried as at 18 between the first sections of the longitudinal base portion which has diverging second sections extending outwardly therefrom. A post A is supported by a pair of upright, substantially vertical straps B each of which is secured as by a bolt 19 to an intermediate portion of the transverse base member 17 which extends on either side of the longitudinal base portion. The strap members converge upwardly and are connected as by the bolt 20 to a single point on the tubular post B. An engine mounting means which may be of any standard variety is illustrated at C which includes a support member 21 removably secured by a threaded fastener 22. A support plate 23 is carried by the base 21 and adjustable links 24 are provided for affording a four point securement for the engine illustrated in broken lines at 25.

The base is illustrated as being supported by wheels 26 carried adjacent the ends of the transverse base member and adjacent the diverging end of the longitudinal base portion. A swivel arrangement 27 forms a standard caster arrangement supporting the free ends of the longitudinal base portion.

The longitudinal base portion includes a pair of structural members each having a first section D which is secured as by bolts 28 to an adjacent flange 17*c* of the transverse base member. The first section D is illustrated in the form of a channel member having flanges 29 and a web 30. The second section E is formed by a diverging continuation of the first sections D and form together with the wheels carried at the extremities of the transverse base member a four point support for the wheeled base.

Figure 3:
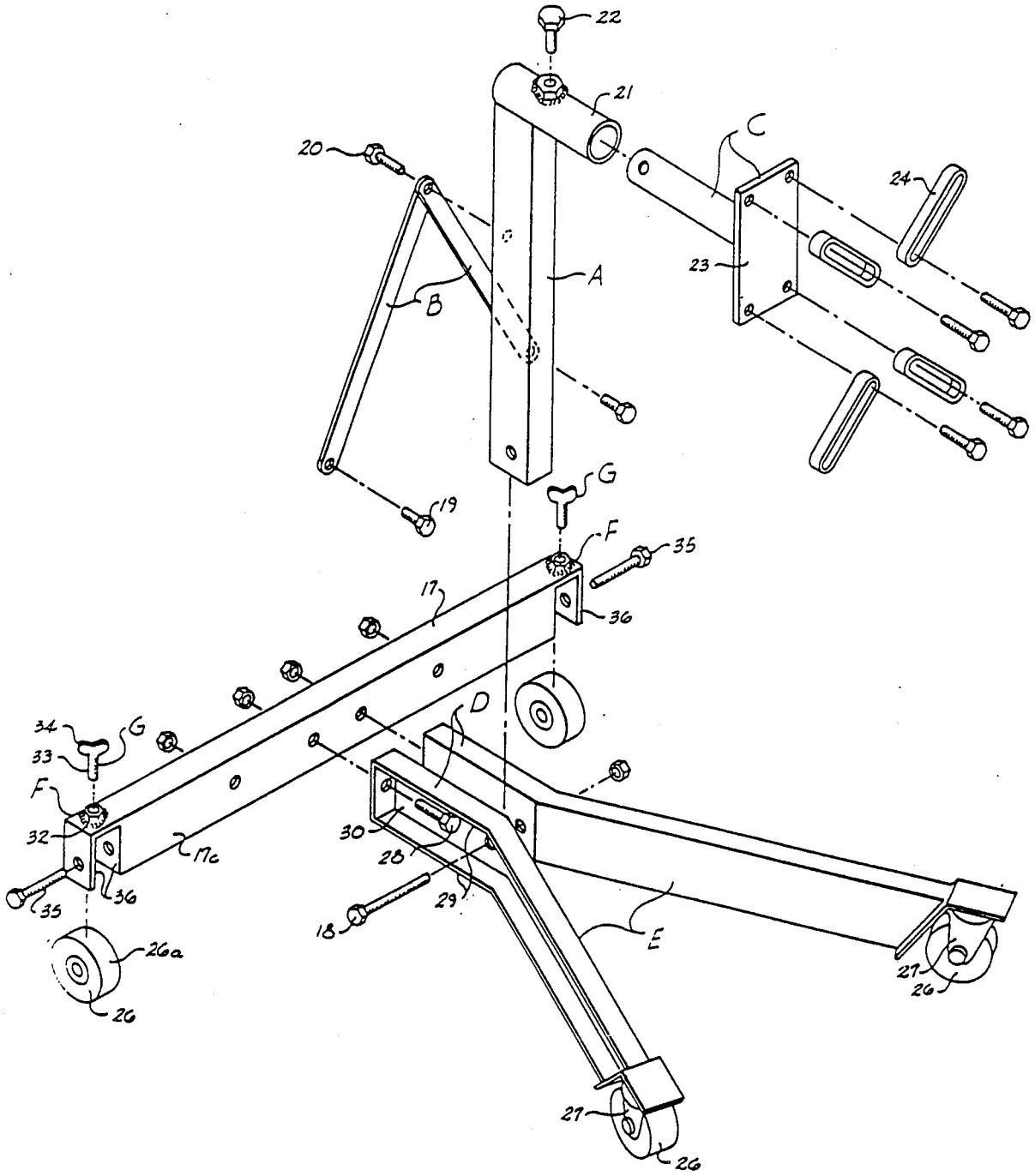
FIG. 3 is a perspective view illustrating the various parts preparatory to assembly.

The braking mechanism is provided by an upper bridging member which is illustrated as being an outward extension of the web portion 17*a* of the tubular transverse base member. The braking mechanism includes an adjustable threaded member G which is carried in an upright internally threaded portion 31 which has a threaded opening 32 extending through the bridging member F so that the threaded opening 32 (FIG. 3) of the threaded member G may receive the threaded shank 33 of the adjustable member G. A wing nut is formed by the wing portion 34 carried by the shank 33 which permits use of the member G as a thumb screw for manual adjustment into and out of braking engagement. The free end of the threaded shank 33 engages the outer periphery 26*a*, in this case, at right angles thereto. The wheel 26 is carried for rotation on the member 35 between the depending supports 36.

Figure 4:
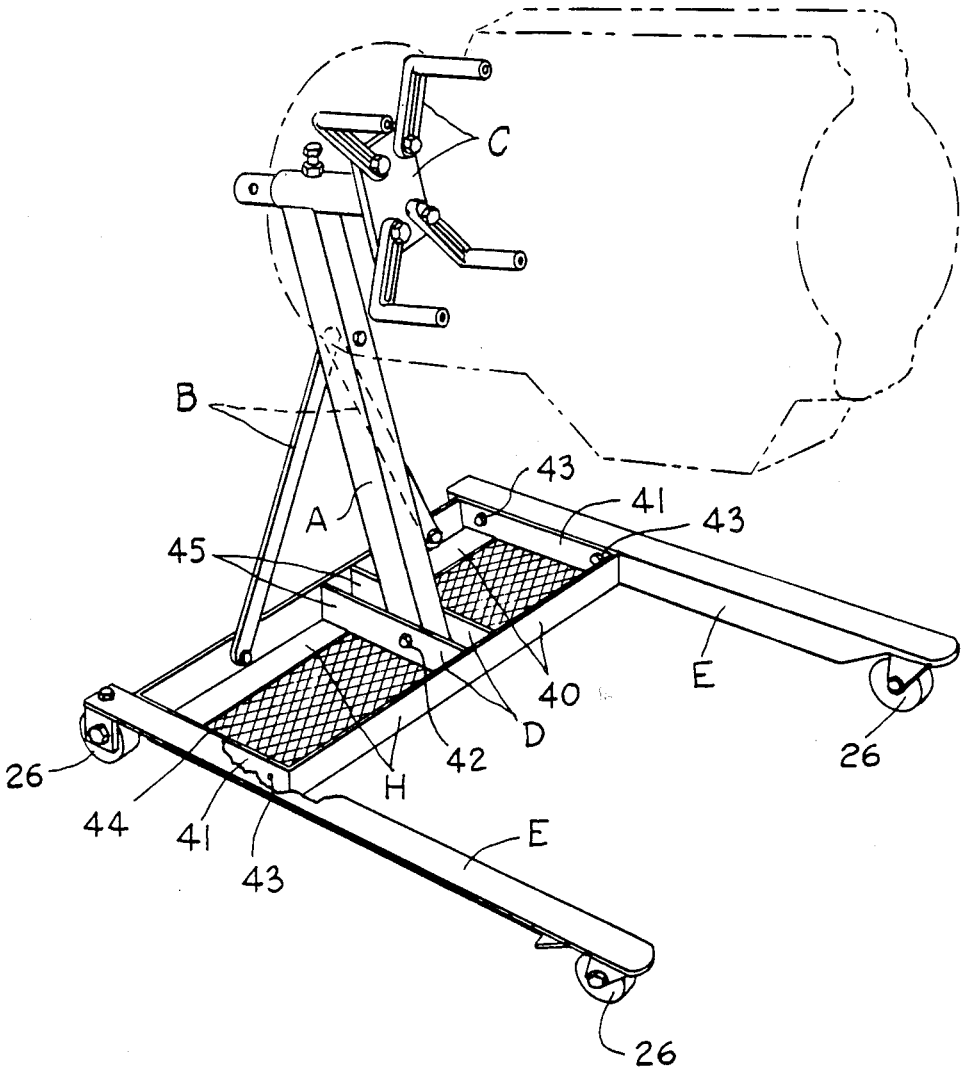
FIG. 4 is a perspective view similar to FIG. 2 illustrating a modified form of the invention.

A modified form of a wheeled stand assembly is illustrated in FIG. 4. A base is formed from a transverse base member, and a longitudinal base portion extending forwardly from said transverse base member, said base being supported by wheels. A post A is carried by the base and is inclined rearwardly toward the transverse base portion. Means including the straps B are provided for supporting the post carried by said base on one end and tapering inwardly toward and being removably connected to the post on the other end. The transverse base member includes a pair of longitudinally spaced transverse structural sections in the form of angle irons 40. A pair of end frame members 41 bridge the longitudinally spaced transverse structural sections and are integrally connected thereto as by welding forming a support frame. Fastening means in the form of a bolt 42 is illustrated as removably securing the post to the support frame. The longitudinal base portion includes a pair of structural members E extending outwardly from the transverse base member in generally longitudinal alignment, and fastening means 43 removably securing the pair of structural members to the transverse base member. A bottom in the form of expanded metal 44 is provided in the frame forming a tray 4.

Engine mounting means C is carried adjacent an upper end of the post extending outwardly above and in alignment with the longitudinal base portion. Means removably securing the post to the frame include a pair of spaced vertical longitudinal structural sections in the form of plates 45 form a part of the base as reinforcement therefor as well as additional fastening means receiving the bolt 42 for securing the post to the base.

While a preferred embodiment of the invention has been described using specific terms, such description is for illustrative purposes only and it is to be understood that changes and variations may be made without departing from the spirit or scope of the following claims.

What is claimed is:

1. An engine stand having a base formed from a transverse base member, and a longitudinal base portion extending forwardly from said transverse base member; said base being supported by wheels, comprising:

a post carried by said base and being inclined rearwardly toward said transverse base portion;

said post being secured to said base by a single transverse bolt;

a pair of upright straps carried by said transverse base member on one end and tapering inwardly toward and being removably connected to said post on the other end;

a pair of spaced vertical longitudinal structural sections forming a part of said base;

fastening means removably securing said post betweeen said spaced vertical longitudinal structural sections;

engine mounting means carried adjacent an upper end of said post extending outwardly above and in alignment with said longitudinal base portion;

said longitudinal base portions including a pair of structural members extending outwardly from said transverse base member in generally longitudinal alignment; and fastening means removably securing said pair of structural members to said transverse base member.

2. A wheeled stand assembly having a base formed from a transverse base member, and a longitudinal base portion extending forwardly from said transverse base member; said base being supported by wheels, comprising:

a post carried by said base and being inclined rearwardly toward said transverse base portion;

said post being removably secured to said base at a lower end thereof;

a pair of strap means supporting said post each being carried by said base on one end thereof on opposite sides of said post and tapering inwardly toward and being removably connected to said post on the other end;

said transverse base member including a pair of longitudinally spaced transverse structural sections;

a pair of end frame members bridging said longitudinally spaced transverse structural sections and being integrally connected thereto forming a support frame;

fastening means removably securing said post to said support frame;

said longitudinal base portion including, a pair of structural members extending outwardly from said transverse base member in generally longitudinal alignment; and fastening means removably securing said pair of structural members to said transverse base member.

3. The structure set forth in claim 2, including a bottom in said frame forming a tray.

4. The structure set forth in claim 3, including engine mounting means carried adjacent an upper end of said post extending outwardly above and in alignment with said longitudinal base portion.

5. The structure set forth in claim 3, including means removably securing said post to said frame.

* * * * *